US007178563B2

(12) United States Patent
Richey, II et al.

(10) Patent No.: US 7,178,563 B2
(45) **Date of Patent: *Feb. 20, 2007**

(54) METHOD AND APPARATUS FOR FILLING PORTABLE HIGH PRESSURE CYLINDERS WITH RESPIRATORY OXYGEN

(75) Inventors: Joseph B. Richey, II, Chagrin Falls, OH (US); Gerold Goertzen, Brunswick, OH (US)

(73) Assignee: Invacare Corporation, Elyria, OH (US)

( * ) Notice: Subject to any disclaimer, the term of this patent is extended or adjusted under 35 U.S.C. 154(b) by 274 days.

This patent is subject to a terminal disclaimer.

(21) Appl. No.: 10/961,018

(22) Filed: Oct. 8, 2004

(65) Prior Publication Data

US 2005/0115630 A1 Jun. 2, 2005

Related U.S. Application Data

(63) Continuation of application No. 10/280,333, filed on Oct. 25, 2002, now Pat. No. 6,889,726.

(51) Int. Cl.
*B65B 1/04* (2006.01)

(52) U.S. Cl. ..... 141/3; 141/18; 141/39; 141/83; 141/231

(58) Field of Classification Search ..... 141/2–7, 141/11, 18, 37, 44, 47, 67, 69, 98, 231; 128/204.18, 128/204.21; 95/130; 96/130
See application file for complete search history.

(56) References Cited

U.S. PATENT DOCUMENTS 6,889,726 B2 * 5/2005 Richey et al. ..... 141/83

* cited by examiner

*Primary Examiner*—Timothy L. Maust
(74) *Attorney, Agent, or Firm*—Calfee Halter Griswold

(57) ABSTRACT

A method of filling a portable tank with compressed oxygen-enriched gas includes the steps of providing a coupling such that when a portable tank is connected with the coupling oxygen-enriched gas can flow through the coupling into the portable tank; directing oxygen-enriched gas from an oxygen concentrator to a compressor; compressing the oxygen-enriched gas in the compressor; directing compressed oxygen-enriched gas from the compressor to a reservoir; storing the compressed oxygen-enriched gas in the reservoir; and thereafter directing stored oxygen-enriched gas from the reservoir to the coupling to enable filling of a portable tank with compressed oxygen-enriched gas from the reservoir.

15 Claims, 3 Drawing Sheets

METHOD AND APPARATUS FOR FILLING PORTABLE HIGH PRESSURE CYLINDERS WITH RESPIRATORY OXYGEN

RELATED APPLICATION

This application is a continuation of prior U.S. application Ser. No. 10/280,333, filed Oct. 25, 2002 now U.S. Pat. No. 6,889,726. Application claims the benefit of the filing date of said prior application. The entire disclosure of said prior application is hereby incorporated by reference.

TECHNICAL FIELD

The present invention relates to a method and apparatus for filling portable high pressure cylinders, or tanks, with respiratory oxygen. In particular, the present invention relates to a system that can fill a portable, or ambulatory, tank with therapeutic oxygen.

BACKGROUND OF THE INVENTION

The HomeFill II Oxygen Compressor system, available from Invacare Corporation of Elyria, Ohio, allows patients to fill their own high-pressure cylinders from a concentrator. The system includes a multi-stage pump that compresses oxygen from an oxygen concentrator into portable oxygen cylinders in sizes M6 and M9. This ability to fill their own portable cylinders gives ambulatory patients greater independence and freedom, and minimizes time-consuming and costly service calls associated with cylinder and/or liquid oxygen deliveries.

Systems of this type are shown in U.S. Pat. Nos. 5,998,165 and 6,302,107.

SUMMARY OF THE INVENTION

In one embodiment, the present invention relates to a method of filling a portable tank with compressed oxygen-enriched gas. The method comprises the steps of:

i. providing a coupling such that when a portable tank is connected with the coupling oxygen-enriched gas can flow through the coupling into the portable tank;
ii. directing oxygen-enriched gas from an oxygen concentrator to a compressor;
iii. compressing the oxygen-enriched gas in the compressor;
iv. directing compressed oxygen-enriched gas from the compressor to a reservoir;
v. storing the compressed oxygen-enriched gas in the reservoir; and thereafter
vi. directing stored oxygen-enriched gas from the reservoir to the coupling to enable filling of a portable tank with compressed oxygen-enriched gas from the reservoir.

The invention also relates to an apparatus for providing oxygen-enriched gas for use by a patient in the form of a portable tank of the gas. The apparatus comprises an oxygen concentrator for providing oxygen-enriched gas. The concentrator has a first output and a second output. A compressor is connected in fluid communication with the first output of the concentrator for compressing oxygen-enriched gas provided by the concentrator. The compressor has an output. A coupling is connected in fluid communication with the output of the compressor. The coupling is adapted to be connected with a portable tank to enable filling of the portable tank with compressed oxygen-enriched gas from the compressor. A reservoir is connected in fluid communication with the output of the compressor for receiving compressed oxygen-enriched gas from the compressor. The reservoir is connected in fluid communication with the coupling to enable flow of compressed oxygen-enriched gas from the reservoir to the coupling to enable filling of the portable tank with compressed oxygen-enriched gas from the reservoir. The reservoir preferably has a capacity of at least about 1,000 standard liters.

BRIEF DESCRIPTION OF THE DRAWINGS

The foregoing and other features of the present invention will become apparent to one skilled in the art to which the present invention relates upon consideration the following description of the invention with reference to the accompanying drawings, in which.

DETAILED DESCRIPTION OF THE INVENTION

Figure 1:
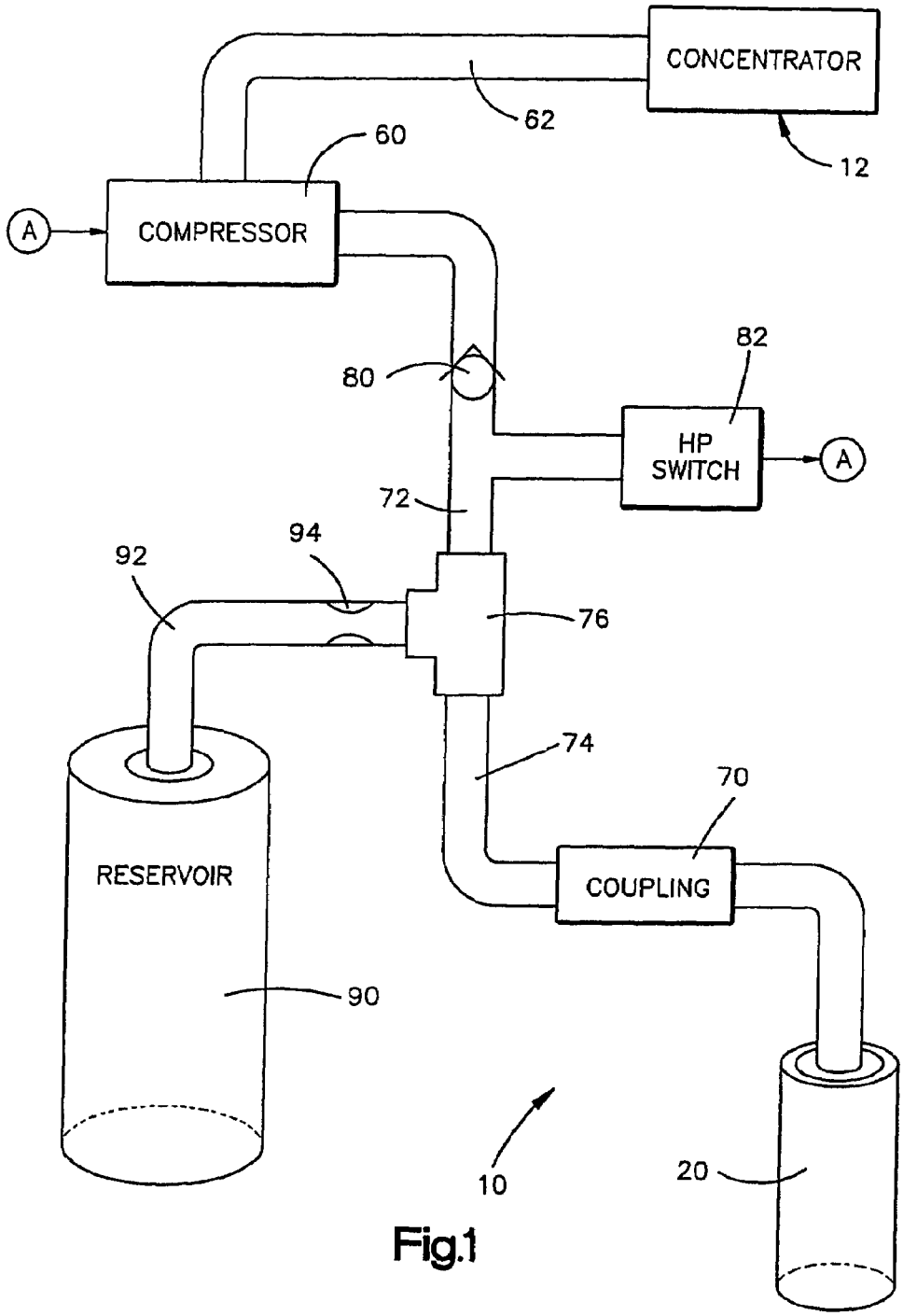
FIG. 1 is a functional block diagram of one embodiment of a system in accordance with the present invention.

The present invention relates to a method and apparatus for filling portable high pressure cylinders, or tanks, with respiratory oxygen. In particular, the present invention relates to a system that can fill a portable, or ambulatory, tank with therapeutic oxygen. The present invention is applicable to filling systems having different constructions. As representative of the present invention, FIG. 1 illustrates schematically one embodiment of a system 10 in accordance with the present invention.

Figure 2:
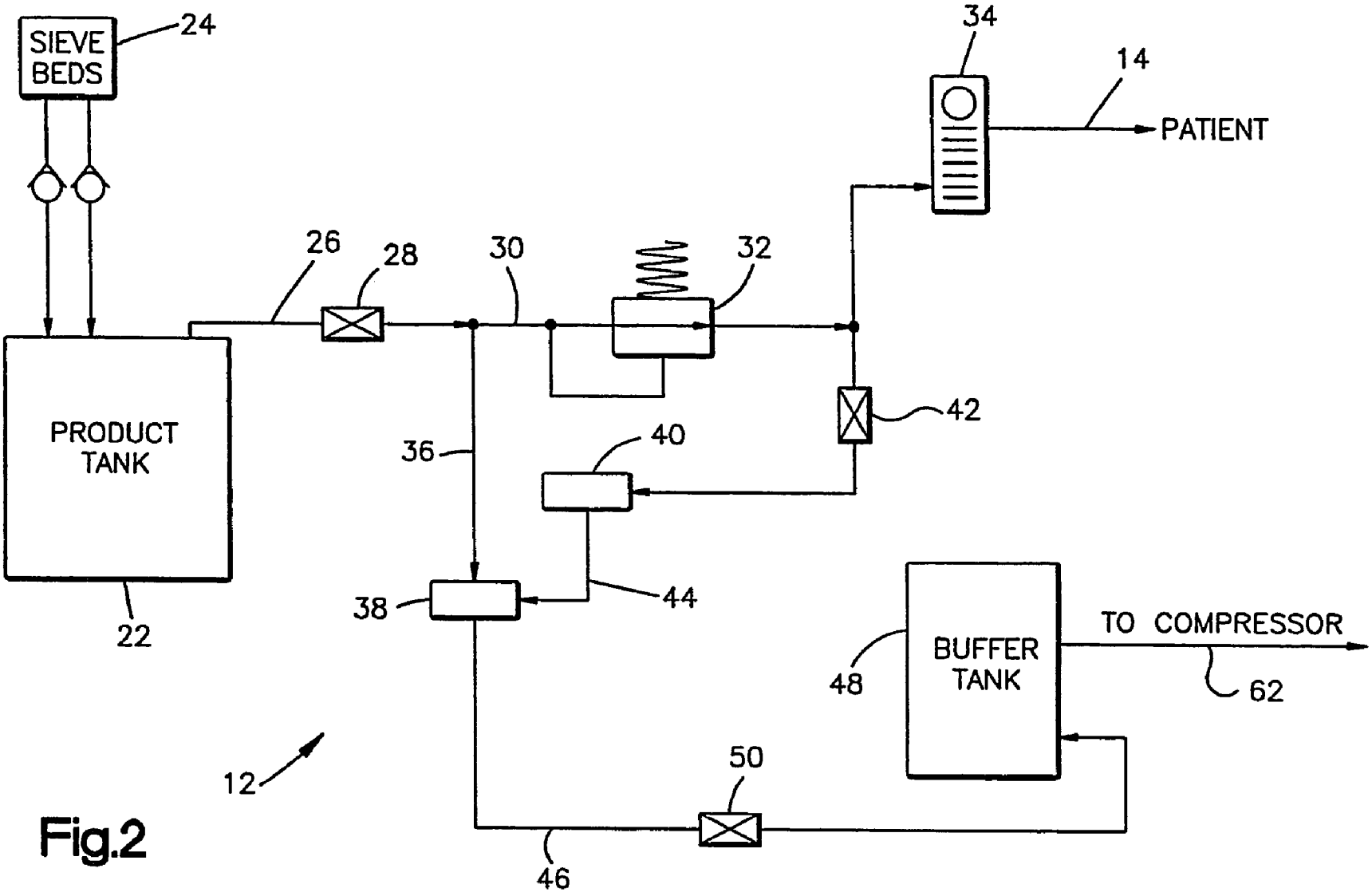
FIG. 2 is a functional block diagram of one embodiment of an oxygen concentrator suitable for use with the system of FIG. 1.

The system 10 is used with an oxygen concentrator 12 (FIG. 2) that provides respiratory gas in the form of oxygen-enriched gas to a patient device indicated schematically at 14, such as a nasal cannula. The system 10 is used to fill a portable cylinder or tank 20 (FIG. 1) with oxygen-enriched gas for ambulatory respiration when the patient is not receiving oxygen-enriched gas directly from the concentrator 12. The tank 20 is carried by the patient and supplies oxygen-enriched gas directly to the patient, without the need for the patient to take along an oxygen concentrator. To this end, the concentrator 12 additionally has an output 62 that directs oxygen-enriched gas, or enables flow of oxygen-enriched gas, to a compressor 60.

The concentrator 12 may be of any known construction. Suitable concentrators 12 are shown in U.S. Pat. No. 5,998,165 and in U.S. Pat. No. 6,302,107, the entire disclosures of which are hereby incorporated by reference. The concentrator 12 is operative to produce oxygen-enriched gas (hereinafter, "gas") at a flow rate of about five (5) liters per minute, at a pressure of about 14–21 psig.

Specifically, the concentrator 12 includes a product tank 22 for receiving oxygen-enriched gas from one or more sieve beds 24. Gas from the product tank 22 flows into a flow line 26 having a flow rate restrictor 28.

The flow is then split. A first portion of the oxygen-enriched gas flows via a line 30 through a 5-psi regulator 32 and into a flow meter 34. Gas is directed to the patient device 14 at a desired flow rate of generally from 0.1 to 6 liters per minute.

A second portion of the oxygen-enriched gas from the product tank 22 is directed via a line 36 to a two-way valve 38. The valve 38 is controlled by the output of an oxygen sensor 40.

A small portion of the oxygen-enriched gas going to the flowmeter 34 is diverted through a flow restrictor 42 to the oxygen sensor 40. The oxygen sensor 40 is set at a predetermined value, such as a concentration of 84 to 94 percent oxygen, so that when the predetermined value is not achieved, the two-way valve 38 is closed by a signal on electrical line 44. This blocks flow of the oxygen-enriched gas through the line 36, allowing the amount of oxygen in the product tank 22 to be increased. This also prioritizes the concentration of oxygen to ensure that the patient device 14 receives respiratory gas with at least a minimum predetermined oxygen content.

When the oxygen concentration at the sensor 42 is sufficient, the valve 38 is opened and oxygen-enriched gas flows through a line 46 into a buffer tank 48. The buffer tank 48 is used to provide a steady flow of oxygen-enriched gas for a compressor 60 downstream.

The oxygen-enriched gas flows from the buffer tank 48 to the compressor 60 via a line 62. Should the compressor 60 withdraw gas faster than it is being received by the buffer tank 48, the pressure in the buffer tank drops. A pressure sensor switch (not shown) in the buffer tank 48 can be set to a predetermined value to ensure or prioritize that a sufficient amount or flow of oxygen-enriched gas is being fed to the patient device 14.

The system 10 includes a coupling 70 (FIG. 1) for connecting a portable tank 20 to the system to enable filling of the portable tank. The coupling 70 may be any suitable coupling to which the portable tank 20 may be connected for filling. In a preferred embodiment, the coupling 70 is a quick-disconnect coupling that includes two-way check valves. One preferred quick-disconnect coupling 70 is shown and described in co-pending U.S. patent application Ser. No. 10/109,580, filed Mar. 27, 2002, and assigned to the assignee of this invention, which is hereby fully incorporated by reference.

The compressor 60 may be of any type suitable for use in a home fill oxygen system. Such compressors are known and on the market in such systems. The compressor 60 is operative to compress oxygen-enriched gas to a pressure in the range of 2,000 psi to 2,250 psi or more, suitable for filling a portable tank 20.

The output of the compressor 60 is connected by fluid flow conduits, or fluid lines, 72 and 74 to the coupling 70. The fluid lines 72 and 74 are shown as connected to opposite sides of a tee 76, for directing, or enabling, oxygen-enriched gas to flow between lines the 72 and 74 through the tee. The tee 76 is indicated schematically. It should be understood that the tee 76 need not be a simple "tee" connection or fitting, but may instead be formed as fluid passages within a manifold, or as a junction off a single line, or in some other manner.

The system 10 also includes a check valve 80. The check valve 80 is located in the fluid line 72 between the tee 76 and the compressor 60. The check valve 80 is operative to block fluid flow in a direction from the tee 76 into the compressor 60, while allowing fluid flow in a direction from the compressor into the tee and thence to the coupling 70.

The system 10 also includes a high pressure switch 82. The high pressure switch 82 is located in the fluid line 72 between the compressor 60 and the tee 72 and, specifically, between the check valve 80 and the tee. The high pressure switch 82 is operative to sense the pressure in the fluid line 72 between the check valve 80 and the coupling 70, and, in response, open or close a circuit through the switch. The high pressure switch 82 is in series with the motor of the compressor 60, as shown schematically at "A" in FIG. 1 to control operation of the compressor.

Specifically, the high pressure switch 82 is operative to close the circuit, thereby energizing the compressor 60, if the pressure in the fluid line 72 is at or below an adjustable preset minimum pressure P(min). A preferred minimum pressure is 1,950 psi, although the minimum pressure could be in the range of 1,800 psi to 1,975 psi or more.

The high pressure switch 82 is operative to open the circuit, thereby turning off the compressor 60, if the pressure in the fluid line 72 is at or above a preset maximum pressure P(max). A preferred maximum pressure is 2,000 psi, although the maximum pressure could be more or less. The 2,000 psi value is chosen because the typical portable tanks 20 that are used in a home fill oxygen system are pressure rated to 2,000 psi. Use of a higher P(max) pressure might require inclusion of a flow regulator to regulate, or limit, the pressure of fluid flowing into the portable tanks 20, as described below.

The system 10 also includes a reservoir 90. The reservoir 90 is a container for storing pressurized oxygen-enriched gas from the compressor, and for, thereafter, delivering stored oxygen-enriched gas for filling a portable tank. The reservoir 90 is connected to a third side of the tee 76 via a fluid flow conduit or flow line 92 for directing or enabling oxygen-enriched gas to flow between the reservoir and the tee.

The reservoir 90 has a substantially greater capacity than the portable tank. It is preferred, but not necessary, that the capacity of the reservoir 90 be in the range of from three times the capacity of the portable tank 20, to fifty times the capacity of the portable tank 20.

It is preferred, but not necessary, that the capacity of the reservoir 90 be sufficient to fill about one to four portable tanks 20 with oxygen-enriched gas under pressure of at least about 1,700 psi. A reservoir 90 suitable for use in the present invention may have a capacity in the range of from about 1,000 standard liters to about 5,000 standard liters.

The portable tanks 20 to be filled may be the industry standard M6 or M9 tanks, having an oxygen capacity of 144 or 248 standard liters, respectively. In that case, one suitable reservoir 90 is for an MM tank having an oxygen capacity of 3,452 standard liters. Such a reservoir 90 could fill one portable tank 20 to about 1950 psi, a second portable tank 20 to about 1900 psi, and so forth.

A flow rate restrictor 94 is optionally located in the flow line 92 from the reservoir 90 to the tee 76. The restrictor 94 limits the rate of fluid flow through the flow line 92, in a direction from the reservoir 90 to the coupling 70, when a portable tank 20 is being filled with stored oxygen-enriched gas from the reservoir. This limitation can prevent excessive heat buildup in the parts of the system 10 resulting from gas flowing rapidly through the fluid line 92 from the reservoir 90.

The concentrator 12 (FIG. 2) is operative to provide oxygen-enriched gas to the patient device 14 regardless of whether a portable tank 20 is connected with the coupling 70. In addition, the concentrator 12 is operative to provide oxygen-enriched gas to the patient device 14 regardless of whether the compressor 60 is operating, and whether the reservoir 90 is empty or full. The system 10 is designed to prioritize flow of oxygen-enriched gas to the patient device 14, in a manner similar to that shown in the above-mentioned U.S. Pat. Nos. 5,998,165 and 6,302,107.

When the output of the concentrator 12 is greater than is needed to supply the patient device 14, the excess oxygen-enriched gas from the concentrator is directed, or enabled to flow, to the compressor 60 as described above. At that time, the compressor 60 is operative to refill a portable tank 20, as follows.

The compressor 60 compresses the oxygen-enriched gas flowing into it from the concentrator 12, and outputs oxygen-enriched gas under pressure of about 2,000 psi. The output of the compressor 60 is directed, or allowed to flow, through the line 72 and past the check valve 80 into the tee 76. The oxygen-enriched gas flows from the tee 76, through line 74, and to the coupling 70, pressurizing the coupling.

When a portable tank 20 is connected to the coupling 70, the high pressure oxygen-enriched gas at the coupling flows through the coupling into the portable tank. The portable tank 20 is thereby filled. Filling the portable tank 20 from the compressor 60 takes about 1 to 12 hours, depending on the size of the portable tank.

When no portable tank 20 is present, the output of the compressor 60 is available to recharge or to fill the reservoir 90. The compressed oxygen-enriched gas from the compressor 60 in such a case flows past the check valve 80, into the tee 76. Because no portable tank 20 is present, the coupling 70 is closed, and the oxygen-enriched gas from the compressor 60 therefore is directed, or allowed to flow, through line 92 to the reservoir 90. The reservoir 90 is pressurized (is refilled) with oxygen-enriched gas.

As noted above, the reservoir 90 has a very large capacity compared to the portable tank 20. Therefore, the initial fill time for the reservoir 90 could be as much as a week. Once the reservoir 90 is filled, however, it typically need only be refilled after discharging stored oxygen-enriched gas, as described below, to fill a portable tank 20.

The system 10 is operative to fill a portable tank 20 from the reservoir 90 as follows. The reservoir 90 holds a large quantity of oxygen-enriched gas under high pressure, for example, a capacity of 3,425 standard liters at a pressure of 2,000 psi. This fluid pressure is also present in the line 92, at the tee 76, in the line 74, and at the coupling 70.

When a portable tank 20 is connected to the coupling 70, the oxygen-enriched gas in line 74 flows into the coupling 90. This oxygen-enriched gas is under pressure from the reservoir 90. Therefore, oxygen-enriched gas from the reservoir 90 begins to flow into the portable tank 20 to fill the portable tank. The reservoir 90 can provide flow at a rate of up to about 164 liters per minute or more, depending on the size and pressure of the reservoir. In addition, if the compressor 60 is operating at that time, the compressor adds a relatively small amount to the flow into the tank 20 (small compared to the amount flowing from the reservoir 90).

Because the capacity of the reservoir 90 is so large compared to the capacity of the portable tank 20, the portable tank fills quickly, for example, in 20–30 seconds to one minute. The reservoir 90 preferably has a capacity sufficient to fill, in one minute or less, a portable tank 20 having a capacity in the range of from about 100 to 300 liters. This is substantially faster than the fill time using the compressor 60 alone. This is also substantially faster than the fill time of known home fill systems, including the systems shown in the abovementioned U.S. Pat. Nos. 5,998,165 and 6,302,107.

In addition, the capacity of the reservoir 90 preferably is large enough to fill more than one of the portable tanks 20. Specifically, if the portable tank 20 to be filled is an M6 or M9 tank, and the reservoir 90 has a capacity of 3,452 liters, then two to six tanks can be filled from the reservoir, without the pressure dropping too far below the desired 2,000 psi.

The oxygen-enriched gas in the reservoir 90 can be maintained at a higher pressure, for example 3,000 psi. In such as case, more tanks 20 could be filled, without the system pressure dropping so far that the tanks are not filled at a pressure close to their desired maximum pressure. If the reservoir pressure is thus higher, a smaller reservoir 90 could possibly be used. In that case, however, the tanks 20 being filled from the reservoir 90 would need to be rated for a higher pressure, or a flow (pressure) regulator would need to be provided at additional cost.

The time for the compressor 60 to recharge or refill the reservoir 90 after filling a portable tank 20 is about 1 to 12 hours, depending on the size of the portable tank that is filled and the size of the compressor. A relatively small compressor 60 can be used because this relatively slow fill time is feasible because of the presence of the reservoir 90 in the system for filling the portable tanks 20 without using the compressor 60.

The reservoir 90 is also useful if the electric power to the compressor 60 is cut off, for example, in a power blackout. Numerous portable tanks 20 can be filled from the reservoir 90 without the compressor 60 operating.

Operation of the compressor 60, in filling the reservoir 90 and maintaining it filled, is further controlled by the high pressure switch 82. If the pressure in the fluid conduit 72 is at or less than the predetermined minimum pressure P(min), then the compressor 60 is turned on. The compressor 60 outputs oxygen-enriched gas at a pressure higher than the pressure in the reservoir 90. As a result, the reservoir 90 is filled by the compressor 60. When the pressure in the fluid conduit 72 thereafter reaches or becomes greater than the predetermined maximum pressure P(max), the compressor 60 is turned off.

It is desirable that the compressor 60 turn on after the reservoir 90 is used to fill one portable tank 20. This amount of filling might produce only a relatively small pressure drop in the reservoir 90, however, so a relatively sensitive high pressure switch 82 would be needed.

Figure 3:
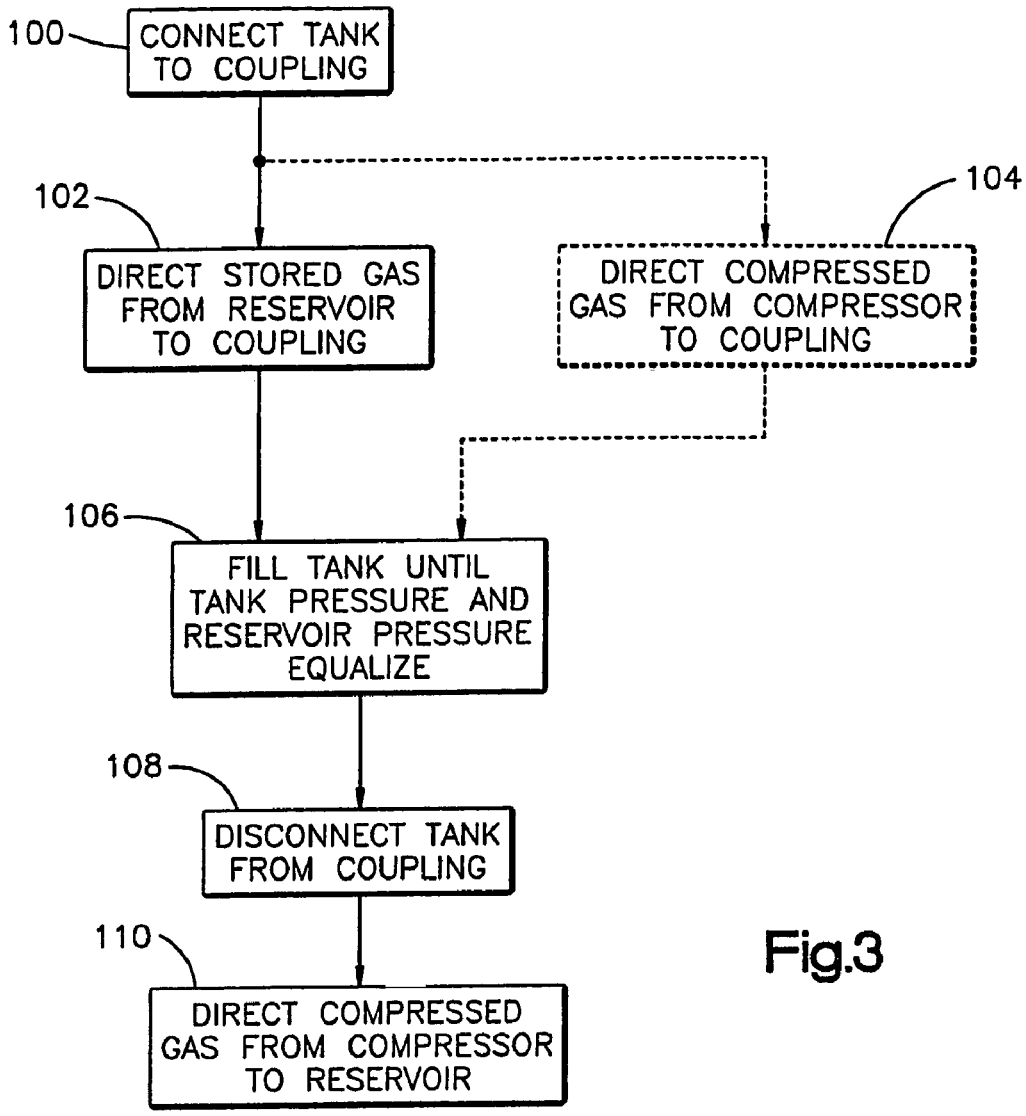
FIG. 3 is a flow diagram of one embodiment of a portion of the process of operation of the system of FIG. 1.

FIG. 3 is a flow diagram of a portion of the process of operation of the system 10. At Step 100 the portable tank 20 is connected to the coupling 70. At Step 102 stored oxygen-enriched gas is directed, or allowed to flow, from the reservoir 90 to the coupling 70.

If the compressor 60 is operating at the time the tank 20 is connected to the coupling 70, then at Step 104, simultaneously with Step 102, compressed oxygen-enriched gas is directed, or allowed to flow, from the compressor to the coupling. The amount of oxygen-enriched gas that flows from the compressor 60 to the tank 70 is likely minimal compared to the amount of oxygen-enriched gas that flows from the reservoir 90 to the tank.

As the portable tank 20 fills with oxygen-enriched gas from the reservoir 90, the internal pressure of the portable tank increases, and the internal pressure of the reservoir decreases. When the two pressures equalize, the flow of oxygen-enriched gas from the reservoir 90 to the portable tank 20 ceases, and the portable tank is thus filled, at Step 106.

The portable tank 20 may then, optionally, be disconnected from the coupling 70 at Step 108. At Step 110, thereafter, compressed oxygen-enriched gas is directed, or allowed to flow, from the compressor 60 to the reservoir 90, to refill the reservoir, if the compressor is operating at the time. If not, then once the system pressure decreases below P(min), the high pressure switch 82 signals the compressor 60 to start operation again, and it is operated until the reservoir 90 is refilled.

Figure 4:
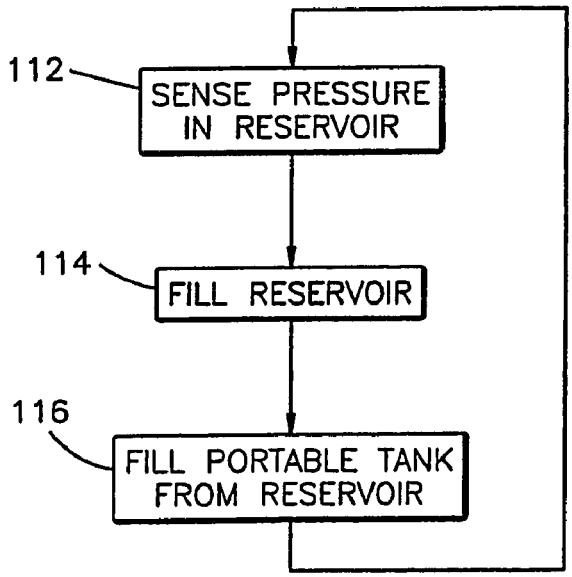
FIG. 4 is a flow diagram of one embodiment of another portion of the process of operation of the system of FIG. 1.

FIG. 4 is a flow diagram of another portion of the process of operation of the system 10. At Step 112 the pressure in the reservoir 90 is sensed by the pressure switch 82. When the sensed pressure decreases to a pressure below P(min), the reservoir is refilled at Step 114 with compressed oxygen-enriched gas from the compressor 60.

At Step 116 a portable tank 20 is filled from the reservoir 90. When this occurs, it is possible that the pressure in the reservoir 90 decreases to a pressure below P(min). Therefore, the process loops back to Step 112 where the pressure in the reservoir 90 is again sensed by the pressure switch 82.

From the above description of the invention, those skilled in the art will perceive improvements, changes, and modifications in the invention. Such improvements, changes, and modifications within the skill of the art are intended to be included within the scope of the appended claims.

The invention claimed is:

1. A method of providing oxygen-enriched gas from a concentrator to a patient for use outside of the patient's home, said method comprising the steps of:

providing a portable tank suitable for the patient to use outside of the patient's home;

directing oxygen-enriched gas from a concentrator to a compressor;

compressing the oxygen-enriched gas;

storing the compressed oxygen-enriched gas in a reservoir;

filling the portable tank with compressed oxygen-enriched gas from the reservoir at a first transfer rate;

depleting the portable tank by directing oxygen-enriched gas from the portable tank to the patient;

charging the reservoir with compressed oxygen-enriched gas from the compressor at a second transfer rate less than the first transfer rate; and re-filling the portable tank with compressed oxygen-enriched gas from the reservoir at a third transfer rate greater than the second transfer rate.

2. A method as set forth in claim 1 wherein said steps of filling the portable tank and charging the reservoir and refilling the portable tank are performed in the patient's home.

3. A method as set forth in claim 1 wherein said step of charging the reservoir is performed at least partially at the same time as said step of depleting the portable tank.

4. A method as set forth in claim 1 further including the step of disconnecting the portable tank from the reservoir for use by the patient at a location remote from the reservoir, this step being performed after the step of re-filling the portable tank.

5. A method as set forth in claim 1 wherein the third transfer rate is substantially the same as the first transfer rate.

6. A method as set forth in claim 1 wherein the first transfer rate is sufficient to fill the portable tank in about one minute or less.

7. A method as set forth in claim 1 further including the step of providing a coupling for connecting portable tank with the reservoir, and the wherein said steps of directing oxygen-enriched gas from a concentrator to a compressor, compressing the oxygen-enriched gas, storing the compressed oxygen-enriched gas in a reservoir, and providing a coupling, are performed in one home-sized unit.

8. A method as set forth in claim 1 wherein the portable tank has a capacity in the range of from about 100 standard liters to about 300 standard liters and is filled to a pressure of at least about 1,800 psi,

9. A method as set forth in claim 1 further comprising the step of directing a second portion of the oxygen-enriched gas from the concentrator to a patient device, performed simultaneously with said step of directing oxygen-enriched gas from a concentrator to a compressor.

10. A method of providing oxygen-enriched gas for use by a patient in the form of a portable tank of the oxygen-enriched gas, said method comprising the steps of:

providing an oxygen concentrator and a compressor;

preferentially directing a first portion of oxygen-enriched gas from the oxygen concentrator to a patient device;

optionally directing a second portion of oxygen-enriched gas from the oxygen concentrator to the compressor;

compressing the second portion of oxygen-enriched gas in the compressor;

directing compressed gas from the compressor to a reservoir;

providing a coupling such that when a portable tank is connected with the coupling oxygen-enriched gas can flow through the coupling into the portable tank;

connecting the portable tank to the coupling; and opening a valve between the portable tank and the reservoir to enable the portable tank pressure and the reservoir pressure to equalize.

11. A method as set forth in claim 10 wherein said step of opening a valve is performed with said step of connecting the portable tank to the coupling.

12. A method as set forth in claim 10 wherein said step of directing compressed gas from the compressor to the reservoir is performed before said filling step.

13. A method as set forth in claim 10 wherein said step of directing compressed gas from the compressor to the reservoir is performed after said filling step.

14. A method as set forth in claim 10 wherein said step of optionally directing a second portion of oxygen-enriched gas from the oxygen concentrator to the compressor is performed in response to sensing the oxygen concentration of the first portion of oxygen-enriched gas.

15. A method as set forth in claim 10 wherein said method steps are performed in the patient's home.

* * * * *